US011723125B2

(12) United States Patent
Bouchard et al.

(10) Patent No.: US 11,723,125 B2
(45) Date of Patent: Aug. 8, 2023

(54) METHOD AND SYSTEM FOR A FLICKER-FREE LIGHT DIMMER IN AN ELECTRICITY DISTRIBUTION NETWORK

(71) Applicant: TECHNOLOGIES INTELIA INC., Joliette (CA)

(72) Inventors: Claude Bouchard, Joliette (CA); Alexandre Brouillette, Joliette (CA); Hugo Bayeur, Joliette (CA); Jacques Godin, Joliette (CA)

(73) Assignee: TECHNOLOGIES INTELIA INC., Joliette (CA)

( * ) Notice: Subject to any disclaimer, the term of this patent is extended or adjusted under 35 U.S.C. 154(b) by 325 days.

(21) Appl. No.: 16/465,440

(22) PCT Filed: Nov. 30, 2017

(86) PCT No.: PCT/CA2017/051444
§ 371 (c)(1),
(2) Date: May 30, 2019

(87) PCT Pub. No.: WO2018/098583
PCT Pub. Date: Jun. 7, 2018

(65) Prior Publication Data

US 2020/0008278 A1 Jan. 2, 2020

(30) Foreign Application Priority Data

Nov. 30, 2016 (CA) ..... CA 2950054

(51) Int. Cl.
*H05B 45/30* (2020.01)
*H05B 45/12* (2020.01)
*H05B 39/04* (2006.01)
*H05B 45/50* (2022.01)
*H05B 45/59* (2022.01)
*H05B 45/3575* (2020.01)

(52) U.S. Cl.
CPC ..... *H05B 45/12* (2020.01); *H05B 39/048* (2013.01); *H05B 45/50* (2020.01); *H05B 45/59* (2022.01); *H05B 45/3575* (2020.01)

(58) Field of Classification Search
CPC .. H05B 45/10; H05B 39/048; H05B 45/3575; H05B 45/12; H05B 45/50
See application file for complete search history.

(56) References Cited

U.S. PATENT DOCUMENTS 9,655,178 B1 * 5/2017 Lewis ..... H05B 45/24
2005/0162098 A1 * 7/2005 Ball ..... H05B 45/39 315/291

(Continued)

FOREIGN PATENT DOCUMENTS

WO WO 2006/039789 A1 4/2006
WO WO 2011/114250 A1 9/2011

*Primary Examiner* — Tung X Le
(74) *Attorney, Agent, or Firm* — Brouillette Legal Inc.; Robert Brouillette

(57) ABSTRACT

The invention generally comprises creating a signal conditioner that is capable of filtering, converting, segmenting and producing a periodic waveform from an electrical source, converting in into an electrical signal to drive an electrical device, such as a LED lamp, so that the behavior of the device driven by the electrical signal enables the device to perform a function that is practically free of the variations present in the main electrical source.

25 Claims, 18 Drawing Sheets

(56) References Cited

U.S. PATENT DOCUMENTS

2012/0056553 A1 3/2012 Koolen et al.
2013/0229121 A1 9/2013 Otake et al.
2013/0278159 A1* 10/2013 Del Carmen, Jr. ..... H05B 45/3575 315/240
2014/0159611 A1* 6/2014 Elferich ..... H05B 45/10 315/294
2014/0239849 A1* 8/2014 Del Carmen, Jr. et al. ..... H05B 45/3725 315/307
2014/0265880 A1* 9/2014 Taipale ..... H05B 45/12 315/246
2014/0265898 A1 9/2014 Del Carmen, Jr. et al.
2014/0333228 A1* 11/2014 Angeles ..... H02M 7/2176 315/291
2014/0375222 A1* 12/2014 Rains, Jr. ..... G06N 3/08 315/158
2015/0103568 A1* 4/2015 Del Carmen, Jr. .. H05B 45/385 363/21.16
2015/0181682 A1* 6/2015 Shet ..... H05B 41/392 315/127
2015/0201477 A1* 7/2015 Watanabe ..... H05B 45/38 315/210
2016/0081149 A1 3/2016 Knoll et al.
2016/0135257 A1* 5/2016 Gaknoki ..... H05B 47/28 315/309
2016/0165693 A1* 6/2016 Chowdhury ..... H05B 45/12 315/250
2017/0027029 A1* 1/2017 Hu ..... H05B 45/14
2017/0127489 A1* 5/2017 Zulim ..... H05B 45/20
2017/0150568 A1* 5/2017 Hayashi ..... H05B 39/048
2017/0196062 A1* 7/2017 Wang ..... H05B 45/3725
2019/0132921 A1* 5/2019 Rumer ..... H05B 45/12

* cited by examiner

METHOD AND SYSTEM FOR A FLICKER-FREE LIGHT DIMMER IN AN ELECTRICITY DISTRIBUTION NETWORK

CROSS-REFERENCE TO RELATED APPLICATIONS

The present patent application claims the priority of the Canadian Patent Application No. 2,950,054, entitled "METHOD AND SYSTEM FOR FLICKER FREE LIGHT DIMMER ON AN ALTERNATIVE DISTRIBUTION NETWORK", filed with the Canadian Intellectual Property Office on Nov. 30, 2016, the contents of which are hereby incorporated by reference.

FIELD OF THE INVENTION

The invention presented generally relates to systems and methods allowing to alter and correct the electrical signal of an AC voltage which influence the lighting intensity of an electronic lamp such as a LED lamps with or without a control circuit. The invention also relates to all other areas of control application where an area of the electrical waveform from the electrical power distribution network are removed to control electrical equipment that regulates a function or a process such as the speed of an electric motor.

BACKGROUND OF THE INVENTION

For issues of backward compatibility with incandescent lamps, LED lamp manufacturers generally integrate electronic circuits that track the conduction angle of the supply voltage to vary the light intensity. Unlike the incandescent bulb, the luminous intensity of a LED lamp varies greatly for very small variation of the amplitude of the input voltage, especially near its conduction threshold. The result is that at low intensity, with a slightest disturbance or variation of the electrical signal supplying the LED lamp creates stressful flickering effects for humans and animals.

A popular method for varying the lighting intensity uses a TRIAC based controller. The flickering of lamps at low intensity is often produced by the activation of the TRIAC gated at the time where the amplitude of the electrical signal is below the conduction threshold of the LEDs or when the residual energy cumulated in various electrical components is restored and superimposed to the main voltage. This disturbance is greatly amplified when the length of a conductor that distributes the energy to the lamps is long or when the number of lamps connected to the same source is significant.

Thus, there is a need for an improved control method to limit the flickering effect from lamps or lighting systems and that is designed to reach lower levels of light illumination than the methods currently in use.

SUMMARY OF THE INVENTION

The invention generally consists in creating a signal conditioner capable of filtering, converting, segmenting and generally producing a periodic waveform from an electrical source, converting it into an electrical signal to drive an electrical device, such as a LED lamp, so that the behavior of the device driven by the electrical signal enables the device to perform a function that is practically free of the variations present on the main electrical source.

In another aspect of the invention, an active load rapidly absorbing the residual energy on the lamp side of the conditioner when the conditioner cut-off the power to the device. Unlike a passive charge which typically dissipates a high amount of energy during the conduction phase of the electronic switches, the energy dissipated by the active charge during the conduction phase is almost zero and is limited to the energy accumulated in the electronic components in the device.

In another aspect of the invention, a method to eliminating the flickering of one or more LED lamps on an electrical power distribution network is described. The method includes synchronizing to the zero-crossing of the electrical power distribution network, power the LED lamps when the main voltage is above the conduction threshold of the LED lamps and cut off the power to the LED lamps.

The method may also include, during the cut off phase, means to empty the residual energy accumulated in the LED lamps. The LED lamp can also be activated by means of an electronic switch.

In a further aspect, the method may also include a preload step to store energy in the LED lamp before activating it.

Otherwise, the method also includes voltage rectification to store said energy into a bank of capacitors to later restore this energy in a controlled manner to the LED lamps. The energy recovery can take the form of a sinusoidal waveform, a trapezoidal waveform and/or an arbitrary periodic waveform.

In another aspect of the invention, the method includes measuring the light intensity emitted by the LED lamp and according to the light intensity emitted by the LED lamp, controlling the voltage sent to the LED lamp to obtain a predetermined and stable light intensity.

In one aspect of the invention, a system for eliminating flickering of one or several more LED lamps on an electrical distribution network is described. The system generally includes at least one switch connected to the LED lamp, an active bleeder circuit, a controller configured to synchronize at the zero-crossing voltage of the electrical distribution network, the controller being configured to close the switch when the main voltage is above the conduction threshold of the LED lamp, open the switch to turn off the LED lamp according to the intensity required and activate the bleeder circuit. The controller can also be configured to activate the bleeder circuit when the switch opens.

The system may also include a zero-crossing detection circuit connected to the controller and/or a feedback circuit allowing the correction of the output voltage applied to the LED lamp. The feedback circuit may include a light intensity sensor. This light intensity sensor could be an optical detector configured to convert the light emitted by the lamp into an electrical signal proportional to the light intensity.

In other aspects of the invention, the system also includes a current limiting circuit and/or a supply rectifying circuit system. The rectifying circuit of the power supply may include one or more capacitors configured to store the energy and restore it in a controlled manner to the LED lamps. With the help of a special circuit, the energy stored in the capacitor(s) can be restored in the form of a sinusoidal waveform, a trapezoidal waveform, and/or any arbitrary periodic waveform.

In additional aspects, the system may include an overload protection circuit, a short circuit protection circuit and/or a current meter connected to the LED lamp.

The features of the present invention which are considered novel and inventive will be described in more detail in the claims presented hereinafter.

DESCRIPTION OF THE DRAWINGS

The advantages, objectives and features of the present invention will be more easily observable with reference to the following detailed description which will be made with the aid of the figures in which.

DETAILED DESCRIPTION OF THE INVENTION

A new method and a system for a non-flickering light dimmer on an AC power distribution network will be described below. Although the invention will be described by taking as an example one or more preferred embodiments, it is important to understand that these preferred embodiments are used to illustrate the invention and not to limit its scope.

Figure 1:
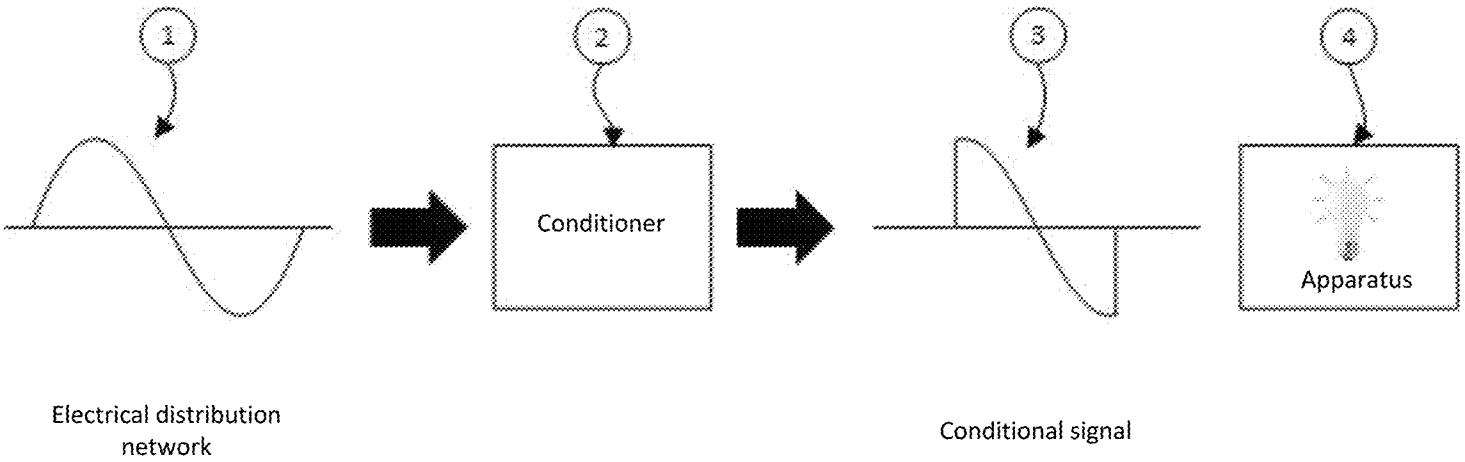
FIG. 1 illustrates the summary of the invention.

Referring to FIG. 1, a possible embodiment of the invention and its interconnection with a device or a series of devices connected in parallel is presented. The system 2, here called the conditioner 2, receives electric power from an alternative voltage source 1. The conditioner applies transformations to the supplied voltage to restore it to a device 4. The apparatus 4 may be a lamp, a motor or any other apparatus which converts electrical signal into any function such as light, motor power, motion, etc.

Electric

Figure 2:
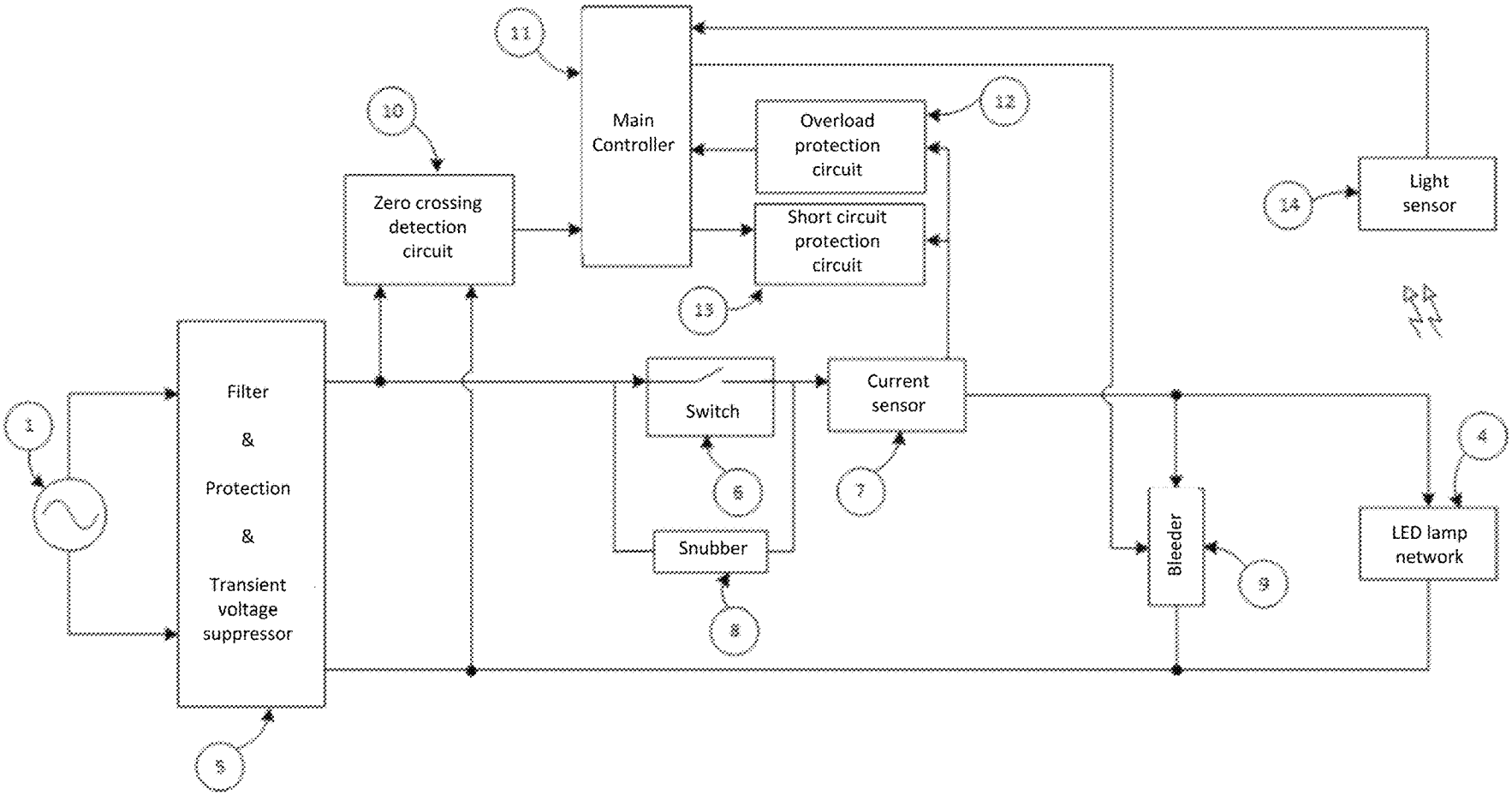
FIG. 2 illustrates the block diagram of the electronic circuit powered by an AC voltage from the electrical distribution network.
Figure 3:
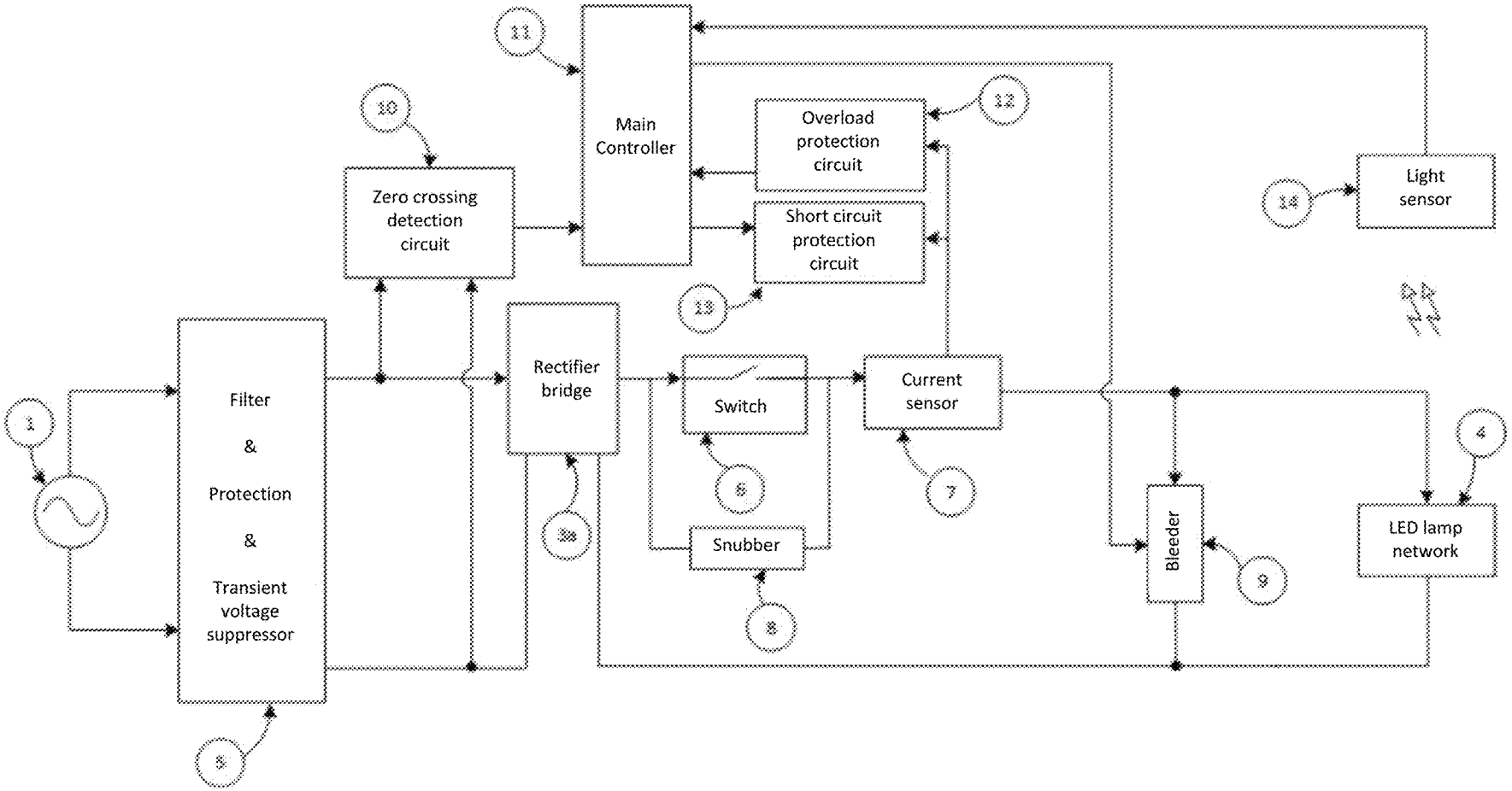
FIG. 3 illustrates the block diagram of the electronic circuit powered by a full-wave rectified DC voltage.

Referring now to FIGS. 2 and 3, two embodiments of circuits or electronic control systems used in the present invention are presented. The circuit illustrated in FIG. 2 typically operates with an AC voltage where the current flowing in the switch 6 is bidirectional. The second circuit illustrated in FIG. 3 has a bridge rectifier 3*a* which converts the AC voltage from the electrical distribution network into a full-wave rectified DC voltage where the current circulating in the switch 6 is unidirectional. The front-end filter and protection circuit 5 aims to protect the electronic components against power distribution network overvoltage and aims to limit the conducted emissions. A zero-crossing voltage detection circuit 10 allows the main controller 11 to synchronize with the beginning of each cycle of the main voltage of the power distribution network. A brightness command from a user interface or from an external circuit (not shown here) enable a sequence of activation to the switch 6 in order to allow the control of the intensity of the LED lamps 4. A snubber circuit 8 allows the absorption of the energy stored in the wiring inductance of the network of the LED lamp and protects the switch 6 against overvoltages. An active bleeder circuit 9 drains the energy accumulated in the snubber circuit 8 as well as the residual energy stored in the components of the LED lamp network in order to guarantee a precise and controlled transition of voltage applied to the LED lamp. The system may include an overload protection circuit 12 and a short-circuit protection circuit at start-up 13, typically implemented using, for example, a current-voltage converter 7. This type of circuit 13 generally allows the protection of the electrical power components against a current overload and also limit the heat dissipation of the components. The system may also include a detection circuit, here expressed by the light detector 14, generally intended to allow a feedback to the controller to regulate, for example, the output voltage to the LED lamps.

Figure 5:
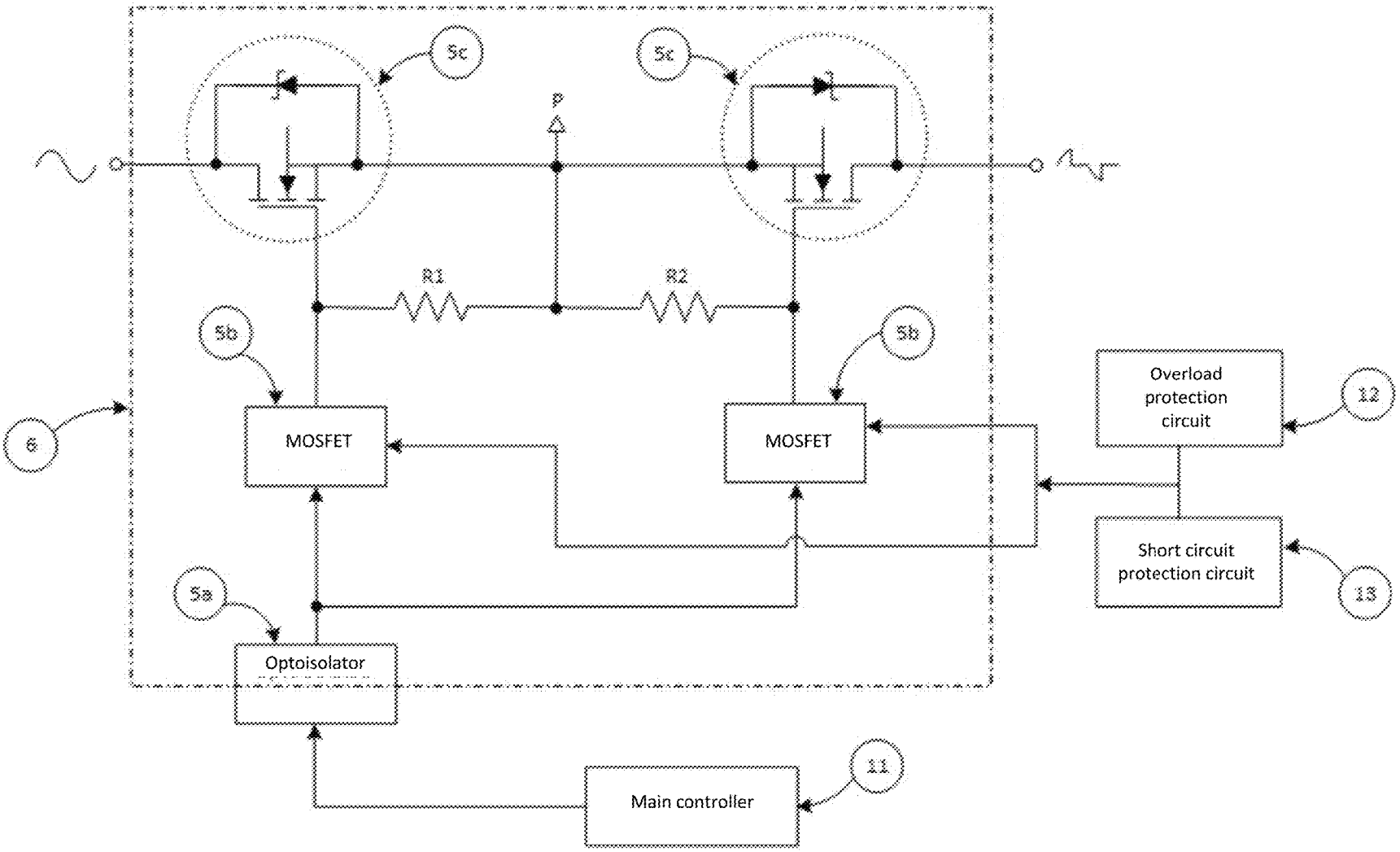
FIG. 5 illustrates the switching circuit powered by an AC voltage from the electrical distribution network.
Figure 6:
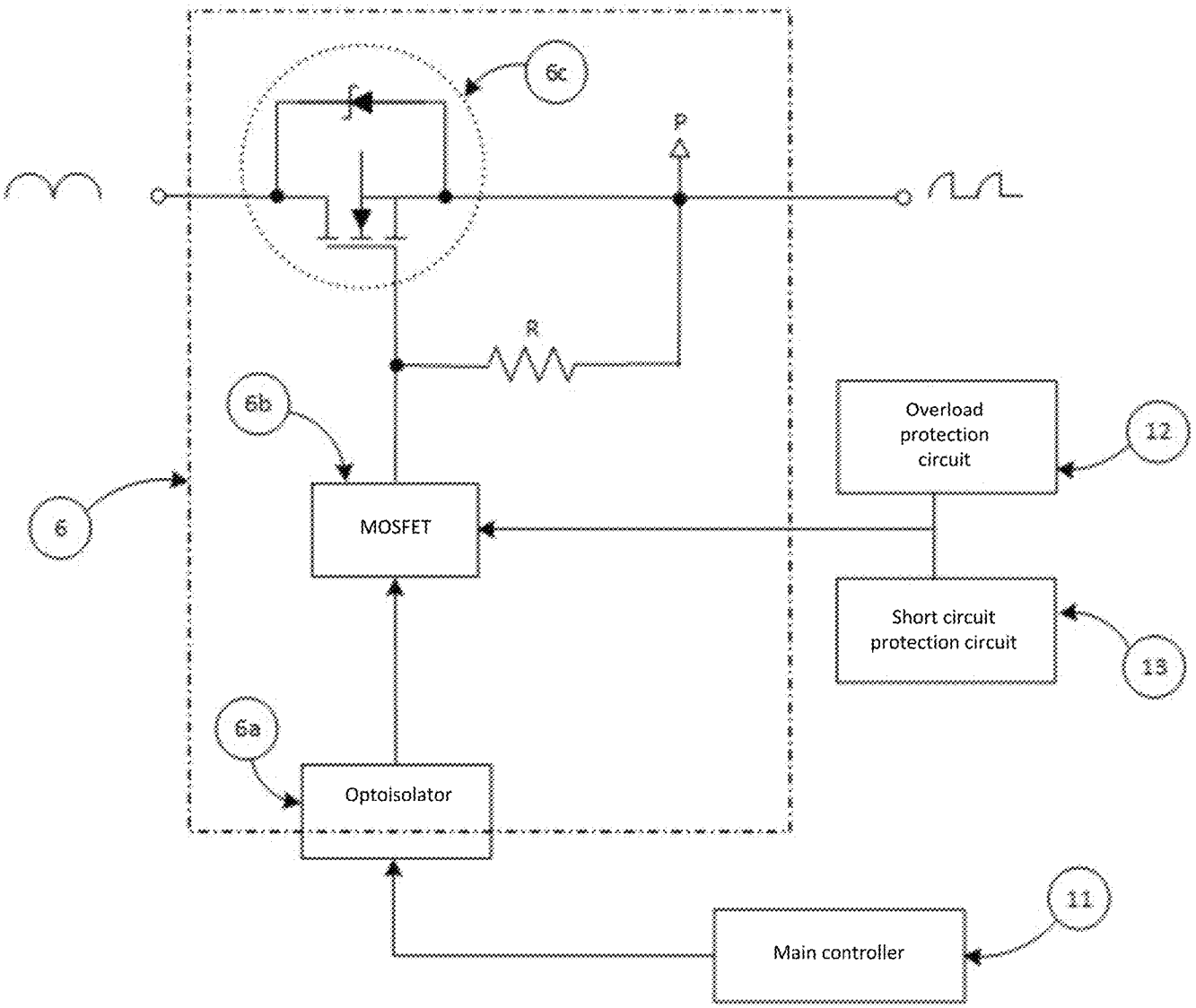
FIG. 6 illustrates the switching circuit powered by a full-wave rectified DC voltage.

Referring now to FIG. 5, an embodiment of the switching circuit of the AC lamp controller is presented. FIG. 6 illustrates a circuit similar to the switching circuit of FIG. 5 but supplied with a full-wave rectified DC voltage. The circuit typically includes a main controller 11 configured to control the activation of the switch 5*c* and/or 6*c* via a galvanic isolation circuit 5*a* and/or 6*a* and a MOSFET driver 5*b* and/or 6*b*. As a preference only, optical isolators 5*a* and/or 6*a* may be used in this circuit. Of course, other components such as magnetic, capacitive, Hall Effect or RF isolators may be used. The switch 5*c* and/or 6*c* may include one or more MOSFETs and/or other components such as bipolar transistors or IGBTs. The use of power MOSFETs connected in parallel is also possible and allows to create a power switch with very low resistance which can significantly reduce the power losses. Such a switch circuit generally aims to reduce the size of the heat sink until it can be removed, if the equivalent thermal resistance allows.

Figure 11:
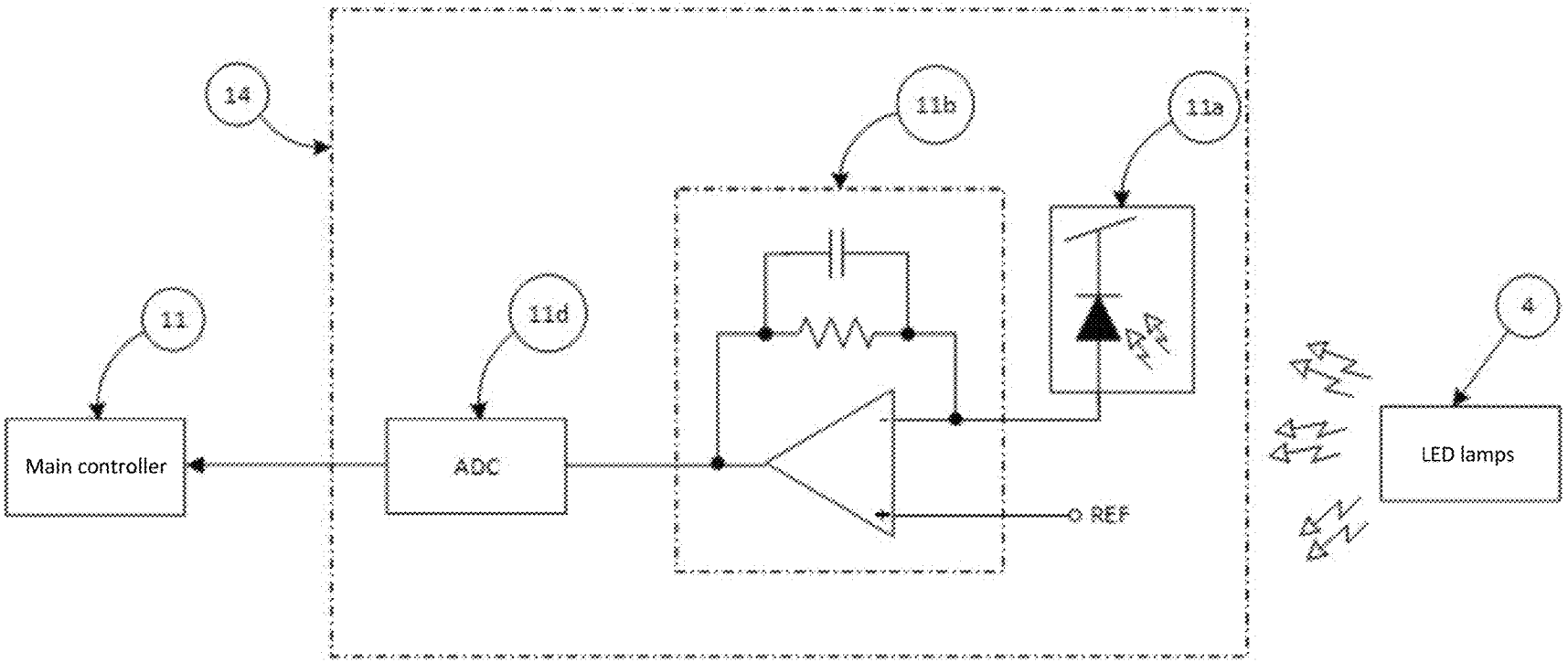
FIG. 11 illustrates the optical feedback circuit to regulate the light intensity.
Figure 12:
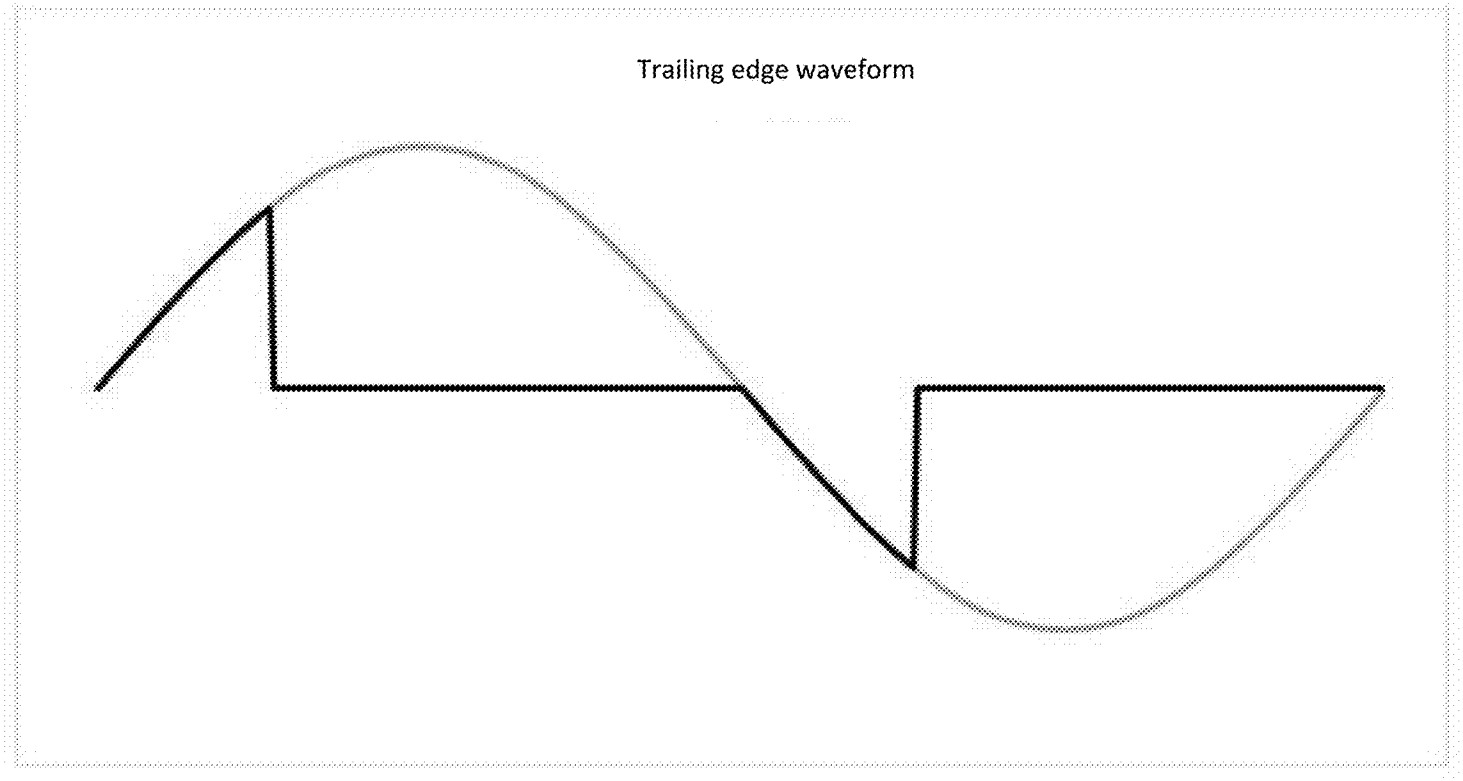
FIG. 12 illustrates the trailing edge control mode.

Referring now to FIG. 11, an embodiment of a feedback circuit 14 generally used for reducing or extending the lamp activation period to regulate the lighting intensity at the requested set point is presented. The circuit 14 is generally made with an optical detector 11*a*. The optical detector 11*a* generally converts the light emitted by the LED lamps into an electrical signal proportional to the light intensity. The electrical signal is then amplified by a transimpedance amplifier 11*b* and then converted to a digital value by the analog-to-digital converter 11*d*. Without limitation, and preferably, a photodiode 11*a* is used in this embodiment of the circuit 14. On the other hand, other optical sensors such as a phototransistor, a photocell or a solar cell may also be used. In other embodiments, the analog-to-digital converter 11*d* may be replaced by a pulse width modulation (PWM) circuit controlled by the output of the amplifier 11*b* and coupled to a logic input of the main controller 11.

The active bleeder 9 is generally intended to absorb some of the residual energy stored by the wiring inductance of the LED lamps cables, the energy stored in the snubber 8 and the residual energy from other electronic components on the line. This absorption typically allows faster cut off of each activation cycle of the switch 6 and generally prevents that this energy be consumed by the lamps. One or more fast turn off time(s) during each cycle of the electrical distribution network aims to better control the LED lamps which have a basic front-end threshold detection circuit as a control circuit in dimming mode.

Figure 7:
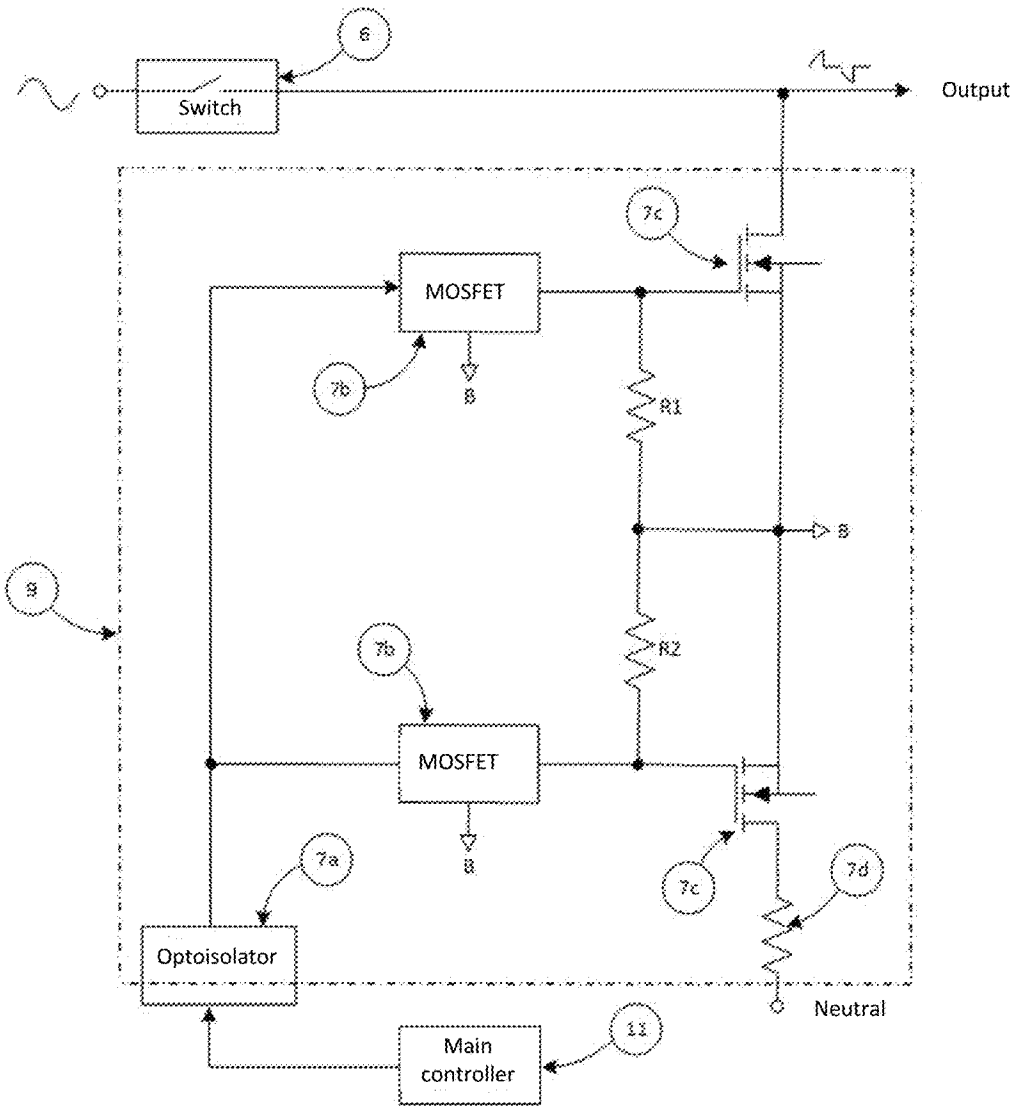
FIG. 7 illustrates the active bleeder circuit powered by an AC voltage from the electrical distribution network.
Figure 8:
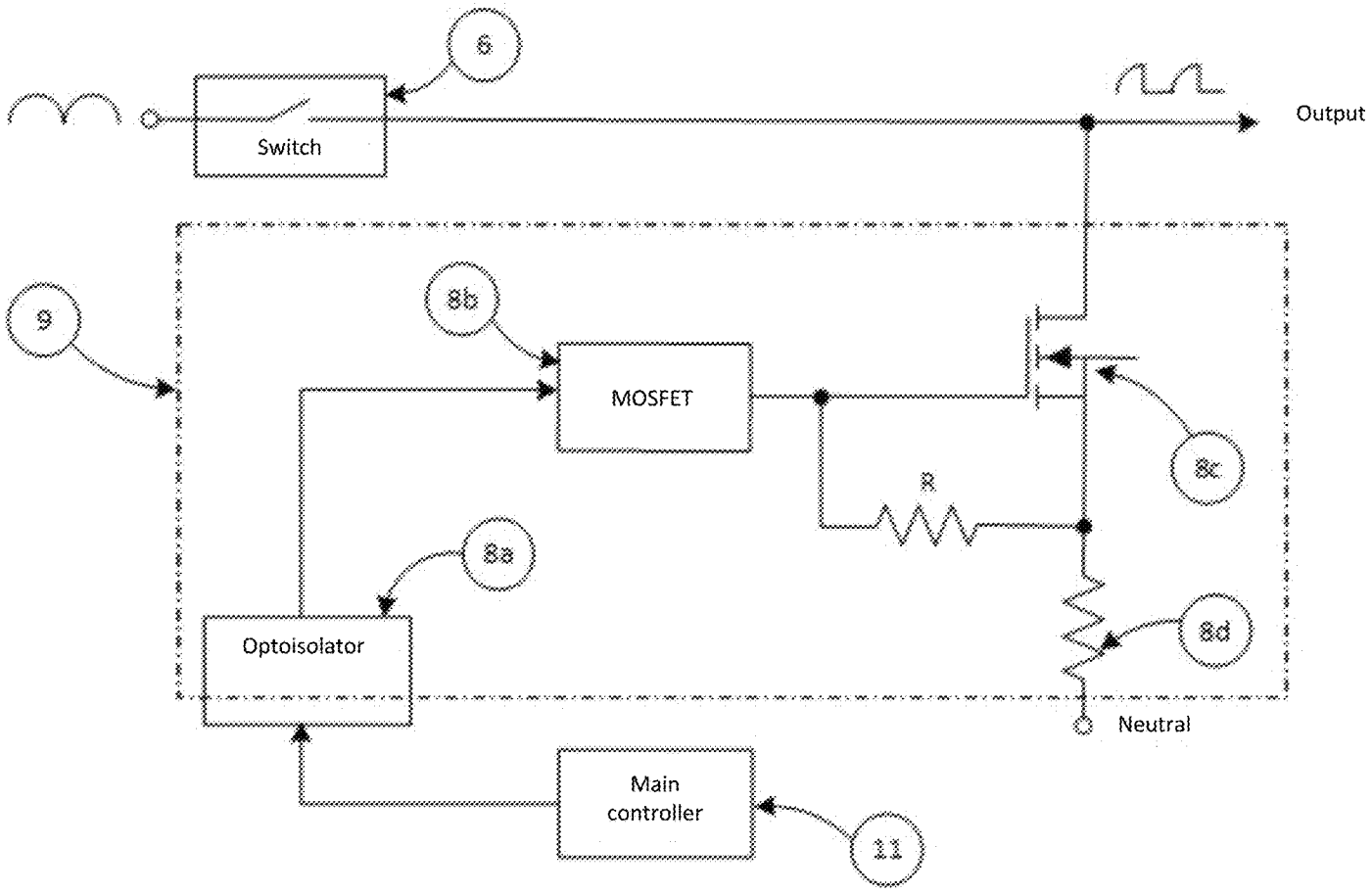
FIG. 8 illustrates the active bleeder circuit powered by a full-wave rectified DC voltage.

Referring now to FIG. 7, an embodiment of an active bleeder circuit 9 in AC mode is presented. FIG. 8, illustrates another embodiment of the circuit 9 of FIG. 7 but with a full wave rectified DC voltage. The active bleeder circuit 9 typically includes a resistive load 7*d* and/or 8*d* which is engaged in parallel with the LED lamps by the switch 7*c*8*c* when the switch 6 open. As a preference only, MOSFETS 7*c* and/or 8*c* may be used to activate the resistive load 7*d* and/or 8*d*. In other embodiment, other components such as bipolar transistors or IGBTs can be used in the circuit 9. The main controller 11 controls the activation of the switch 7*c* and/or 8*c* via a galvanic isolation 7*a* and/or 8*a* and MOSFET driver 7*b* and/or 8*b*. As a preference only, optical isolators 7*a* and/or 8*a* may be used in circuit 9 but other components such as magnetic, capacitive, Hall Effect or RF isolators may be substituted. Without limitation, the activation sequence of the switch 6 and the switch 7*c* and/or 8*c* may be 180 degrees out of phase but may also include a different sequence which allows a better control of the LED lamps.

Figure 9:
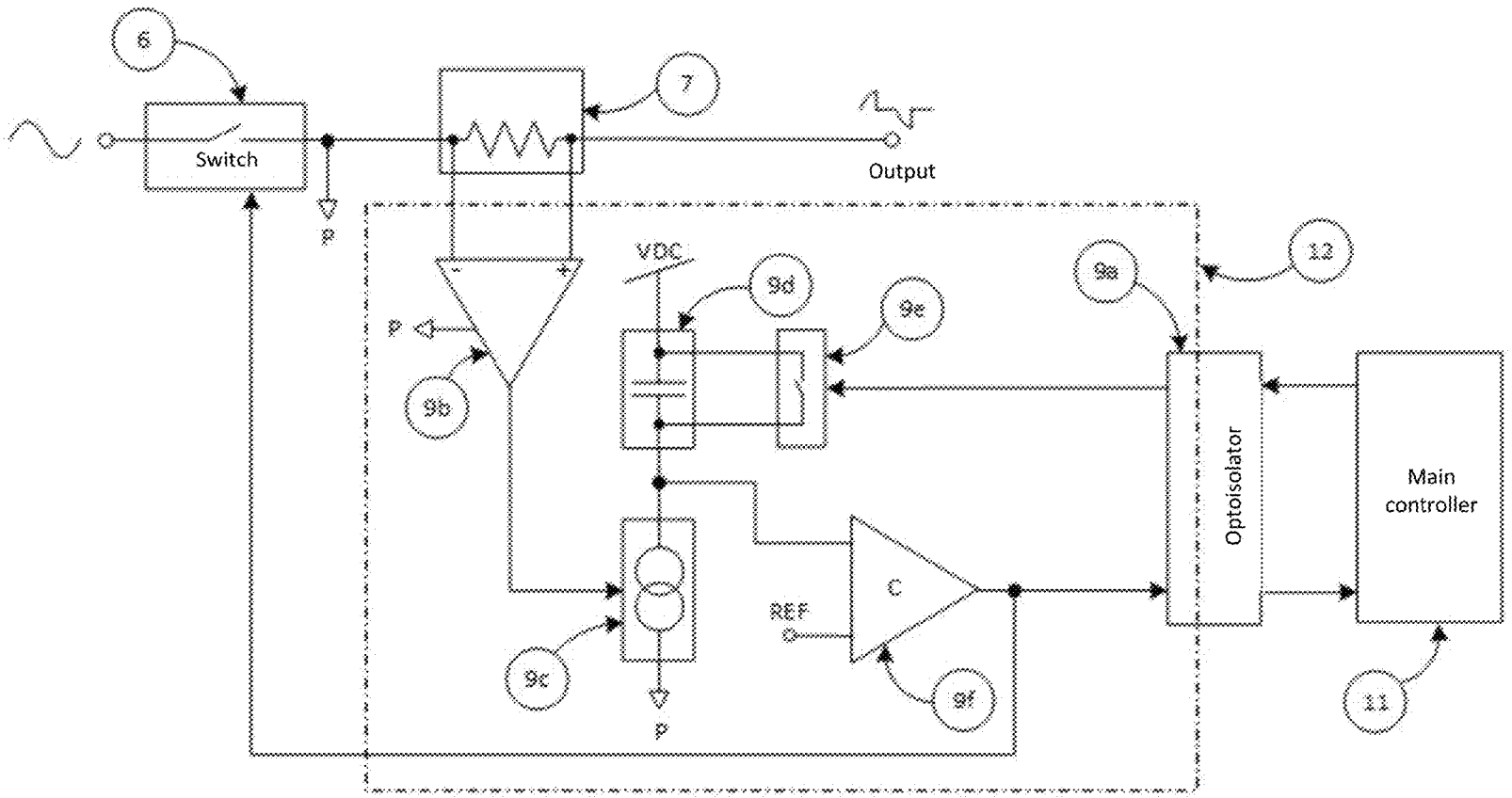
FIG. 9 illustrates the protection circuit against overloads.

Referring to FIGS. 5 and 6, a current limiting circuit 12 including an integrator generally allows the removal of the fuse and protect the power switches 6 against excessive loads. An embodiment of the current limiting circuit 12 is illustrated in FIG. 9 and can function in AC or with a full wave DC voltage. The current measurement through switch 6 is typically done using a current-voltage converter 7, preferably a low value resistor. Without being limited, the current sensor circuit 7 may also include a current transformer or a Hall Effect sensor. The output signal from the current sensor 7 is generally directed to an amplifier 9*b* whose exit drives a variable current source 9*c* where the intensity is proportional to the current flowing in the switch 6. An integrator circuit formed by the current source 9*c*, the capacitor 9*d* and the switch 9*e* allows to integrate the current waveform flowing in the circuit of the LED lamps. The output of the integrator is compared to a reference voltage using the comparator 9*f*. Exceeding the threshold on the comparator 9*f* will cut off the power to the LED lamps by opening the switch 6. This shut down aims to protect the power electronic components. The capacitor 9*d* is discharged at the zero-crossing time of the main supply. The current limiting circuit 12 is typically galvanically isolated using the isolating circuit 9*a*. In a preferred embodiment, the circuit 12 may include optical isolators (9*a*) or other components such as magnetic, capacitive, Hall Effect or RF isolators. The circuit 12 may also include an alarm indicating an overload redirected to the main controller 11 to be processed.

Figure 10:
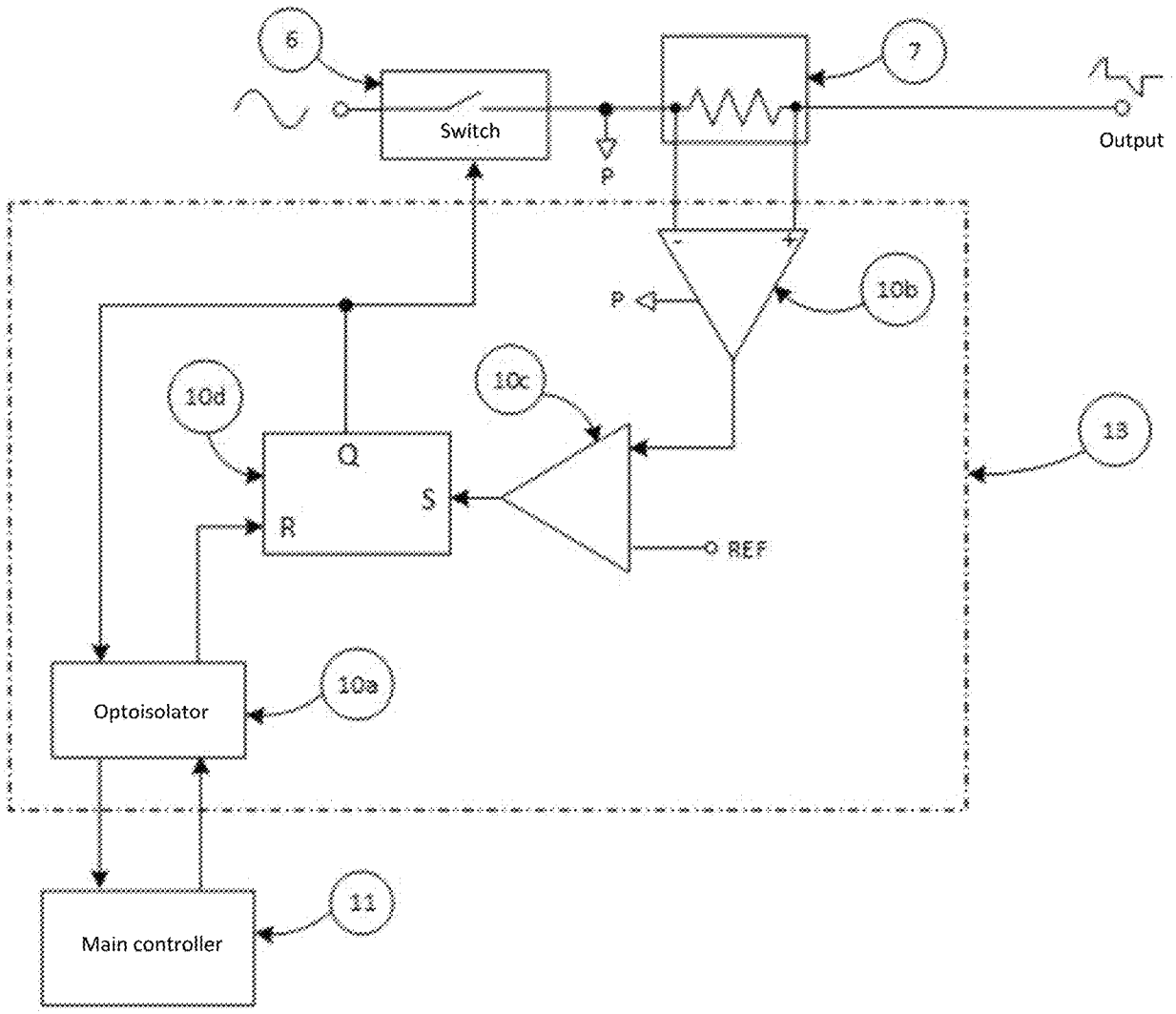
FIG. 10 illustrates the short circuit detection circuit at startup.

A protection circuit against short circuit at start-up 13 generally protects electric and electronic components against overload in case of a bad connection made by the user. A preferred embodiment of the protection circuit 13 is illustrated at FIG. 10, it works in AC or with a full wave DC voltage. The current measurement through switch 6 is typically done using a current-voltage converter 7, preferably a low value resistor. Without being limited, the current sensor circuit 7 may also include a current transformer or a Hall Effect sensor. The output of the current converter 7 is generally directed towards an amplifier 10*b* followed by a comparator 10*c* and a flip-flop D-Latch 10*d*. The peak current flowing through the switch 6 is typically limited by the opening of the switch 6 when the current is above the limiting threshold at each half-cycle of the AC voltage or at each cycle of a full wave rectified voltage. The D-Latch is reset at the zero-crossing time of the supply voltage. The short-circuit protection circuit 13 is generally galvanically isolated using an optical isolator circuit 10*a*. In a preferred embodiment, optical isolators 10*a* are used in this circuit. In other embodiments, other components such as magnetic, capacitive, Hall Effect or RF isolators may be used. An alarm indicating a short circuit at start up can be directed to the main controller 11 for processing.

Figure 4:
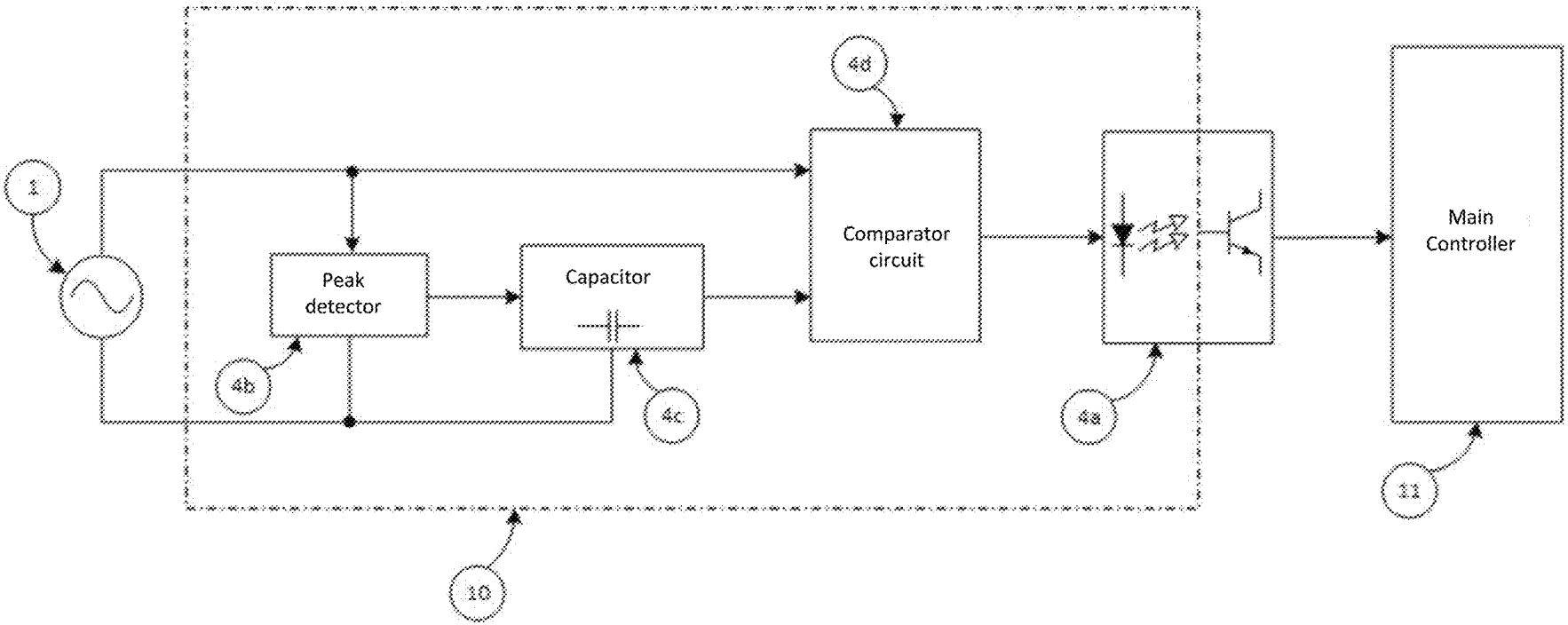
FIG. 4 illustrates the zero-crossing detection circuit of the main voltage.

The zero-crossing detection circuit 10 is done with a fast and precise level detection circuit. An embodiment of the zero-crossing detection circuit 10 is illustrated in FIG. 4. The capacitor 4*c* is charged at the limited voltage determined by the clamping circuit 4*b*. The comparator 4*d* is trigged when the input voltage drops below the voltage reference determined by the voltage across the capacitor 4*c*. Without being limited, the comparator output 4*d* may drive a galvanic isolator 4*a* which transmits the zero-crossing time to the main controller 11. In a preferred embodiment, the circuit 10 may also include an optical isolator. In other embodiments, the circuit 10 may include other components, such as magnetic, capacitive, Hall Effect or RF isolators.

In embodiments where the system includes two or more outputs, the activation of the switches 6 can be delayed by a few microseconds to decrease the inrush current from the electrical distribution network and thus reduce the voltage drop which can impact the behavior of the load 4.

In other embodiments of the invention, other configurations are possible to eliminate the flickering of LED lamps due to fluctuations in the power distribution network by rectifying the input voltage and then storing the energy in capacitor banks in order to restore it to the lamps in a controlled way.

The restitution of the energy may be done in different ways including, for example, a DC constant voltage, a sinusoidal wave whose amplitude and frequency are controlled, a trapezoidal wave that allows better intensity control than the sinusoidal waveform while maintaining slow transitions to reduce conducted emissions and electromagnetic radiation.

The proposed circuit is made with a PWM modulator where the useful cycle varies according to the input waveform. This resulting waveform is then filtered using a passive or active low-pass filter to keep only the DC component. The useful cycle variation changes the amplitude of the DC component and builds an arbitrary periodic waveform that is transmitted to the circuits of the LED lamps.

Software

Figure 13:
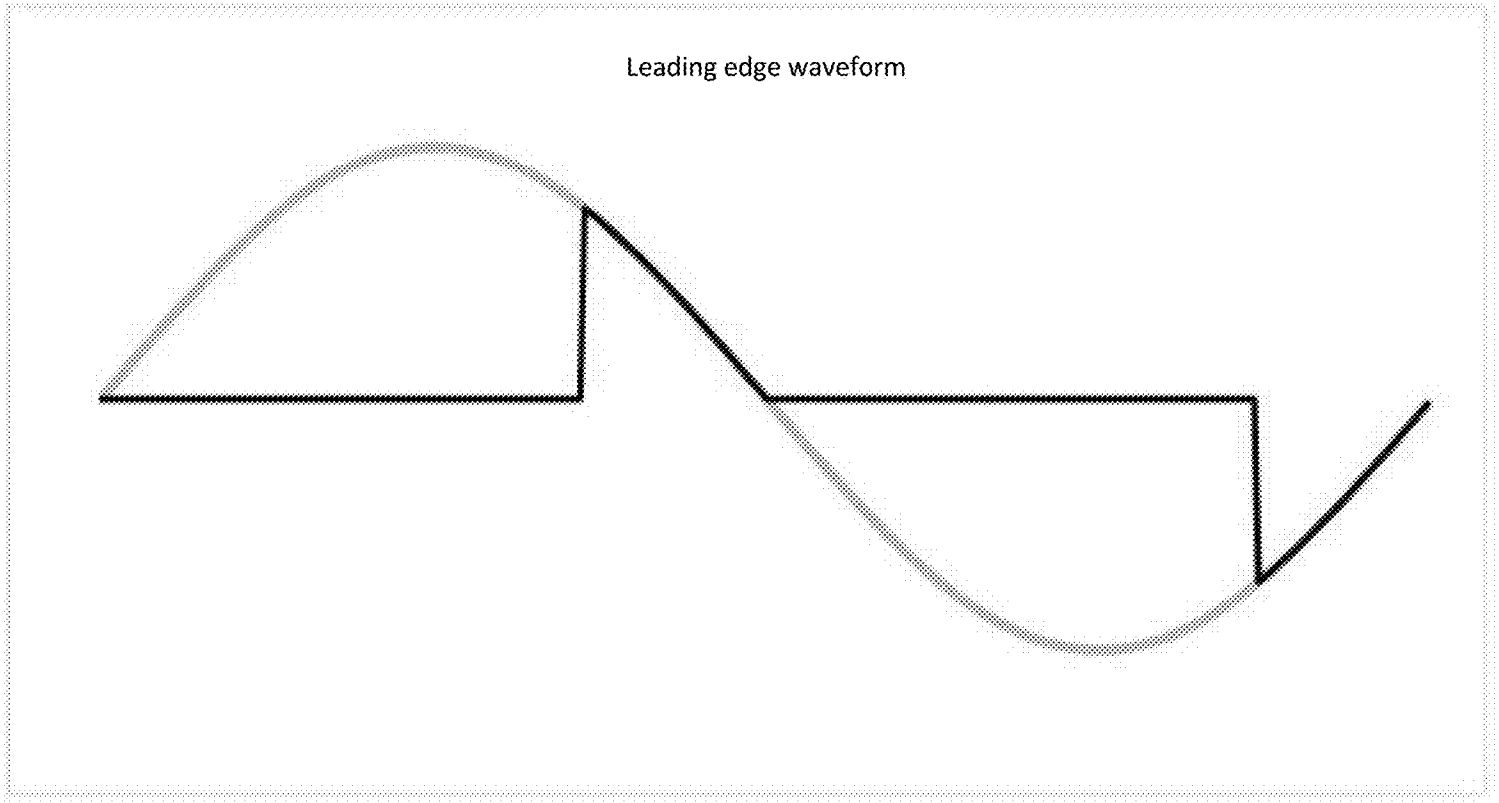
FIG. 13 illustrates the leading-edge control mode.
Figure 14:
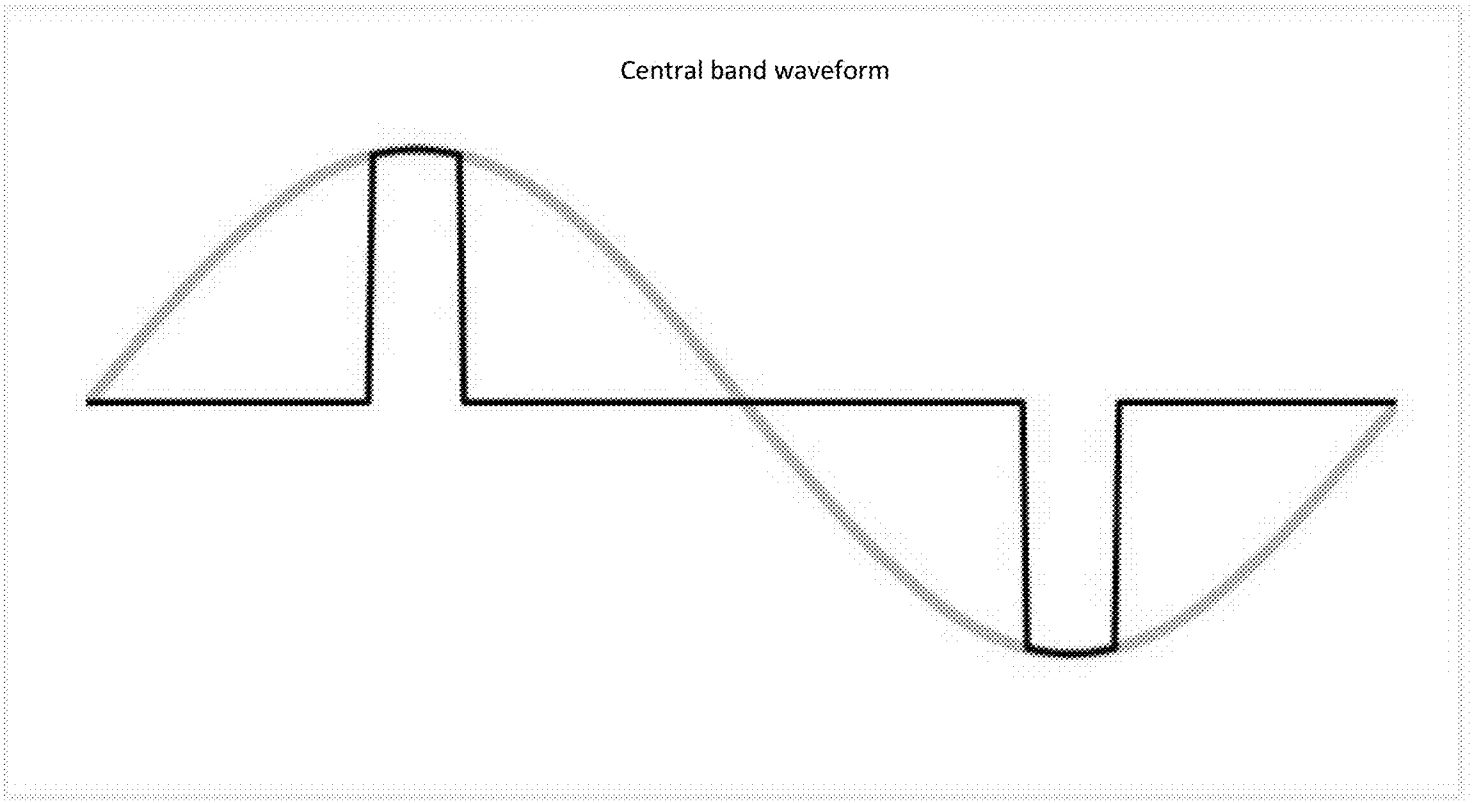
FIG. 14 illustrates the central band control mode.
Figure 15:
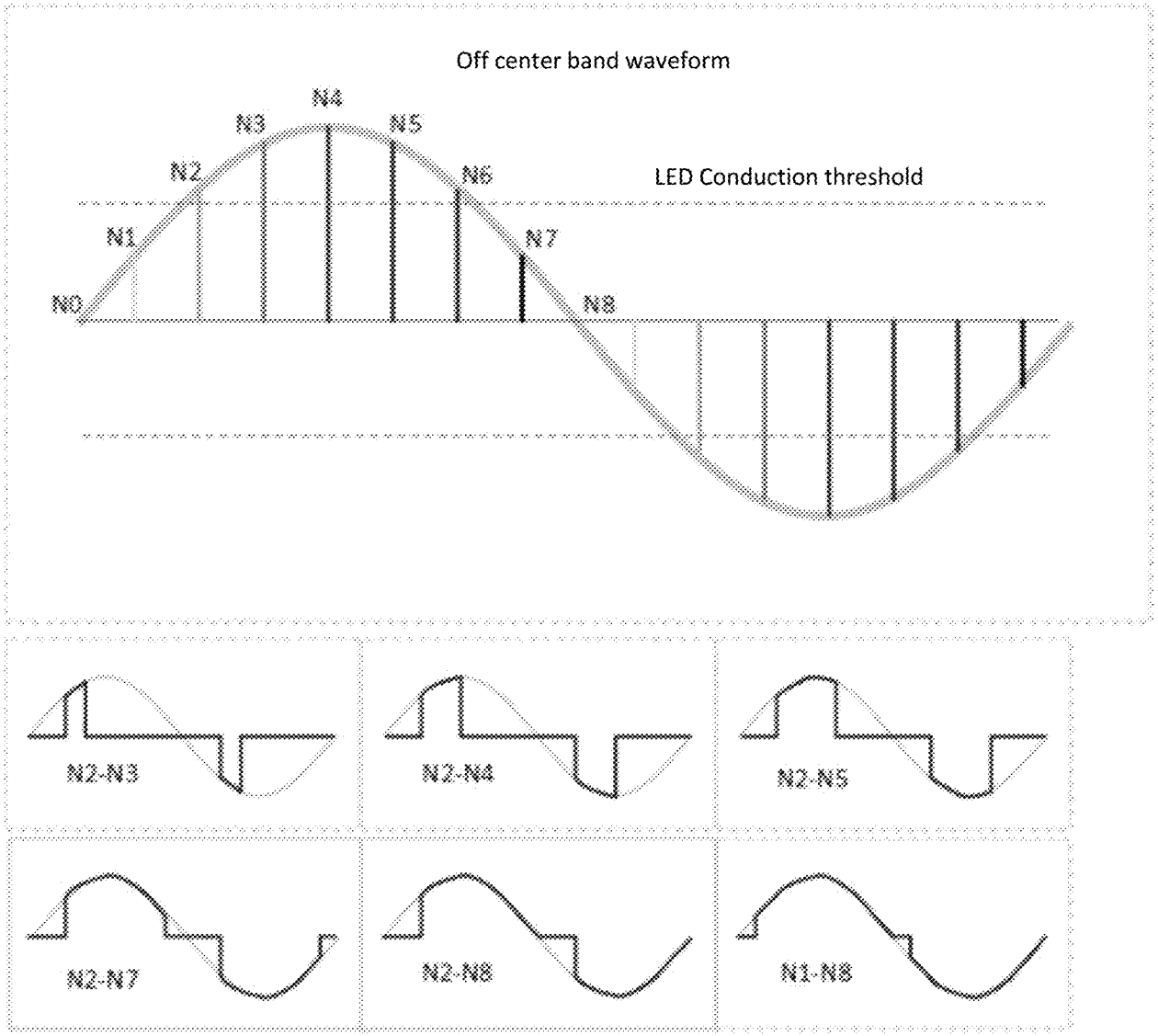
FIG. 15 illustrates the off-centre band control mode.
Figure 16:
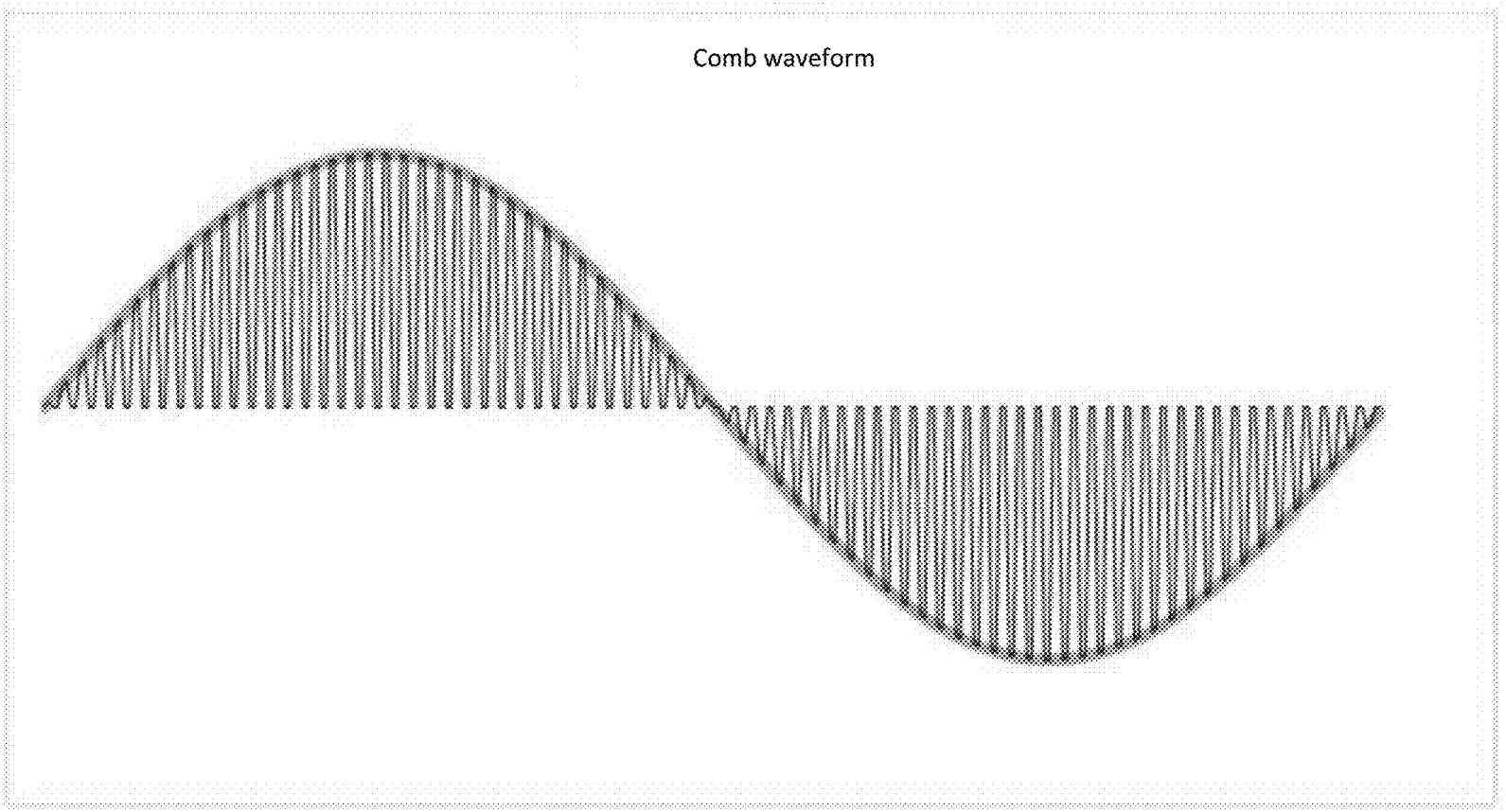
FIG. 16 illustrates the comb type control mode.

Referring now to FIG. 15, a possible embodiment of the off-centre band control mode method is presented. The control method generally aims to offer several advantages including, in many cases, better stability at low intensity of the apparatus 4 and a lower inrush current than the central band mode (FIG. 14) and leading-edge control mode (FIG. 13).

The control method generally consists of turning on the electronic switch 6 when the AC voltage reaches a predetermined amplitude in the modus operandi of the device. The amount of energy delivered to the apparatus 4 is generally determined by the duration of the conduction cycle of the electronic switch 6. Referring to FIG. 15, the energy delivered to the apparatus is progressively increased and follows the following sequence: at the minimum value, the electronic switch is turned on, for example, at N2 and turned off at N3, then gradually from N2 to N4, from N2 to N5, until the conduction window goes from N2 to N8. Following this, the energy is increased by extending the conduction period from N1 to N8, and the maximum energy is transmitted when conduction goes from (N0) to N8. The reduction of the transmitted energy is the opposite of the progression, namely, (N0) to N8, N1 to N8, N2 to N8, N2 to N7, N2 to N6, up to the minimum conduction time of N2 to N3. In FIG. 15, the time interval between N0, N1, N2 . . . N8 is suggestive only and is adapted in accordance with the target device.

Figure 17:
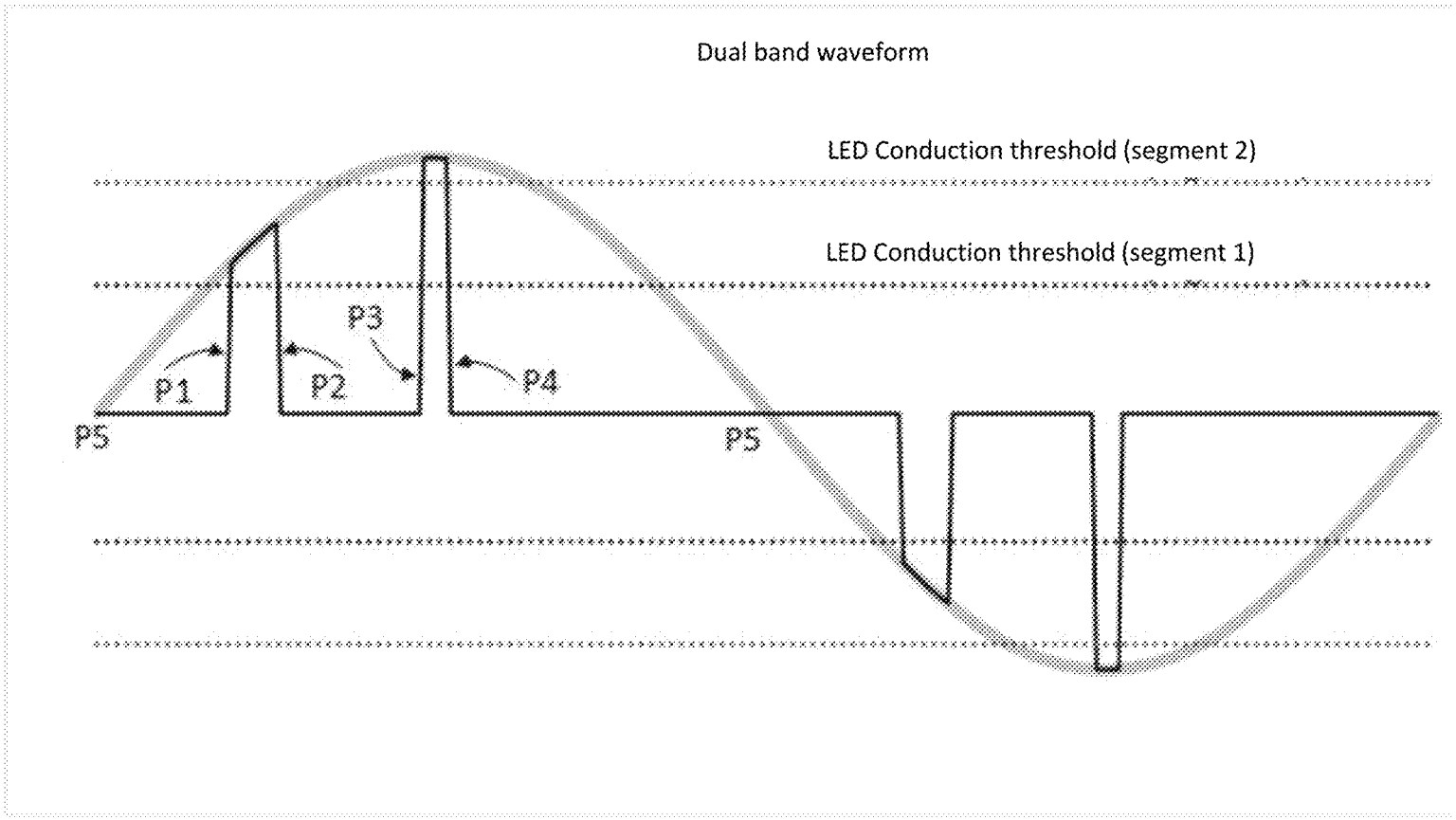
FIG. 17 illustrates the dual-band type control mode.

In embodiments in which the lamp is manufactured with multiple LED string lights in parallel, the control algorithm can allow multiple on-cycles to supply each string light in the conduction band of the LEDs. As illustrated in FIG. 17, the activation can first occur at P1 when the electrical distribution network voltage exceeds the conduction threshold of the first series of LEDs. The intensity is then gradually increased by delaying the first cut-off P2. When the voltage at time P2 approaches the conduction threshold of the second series of LEDs, a second pulse centered on the peak voltage of the voltage line is activated. Eventually, the second pulse will merge with the first one when P2 and P3 overlap. Finally, P1 and P4 move toward their zero-crossing P5 to obtain a full wave.

Figure 18:
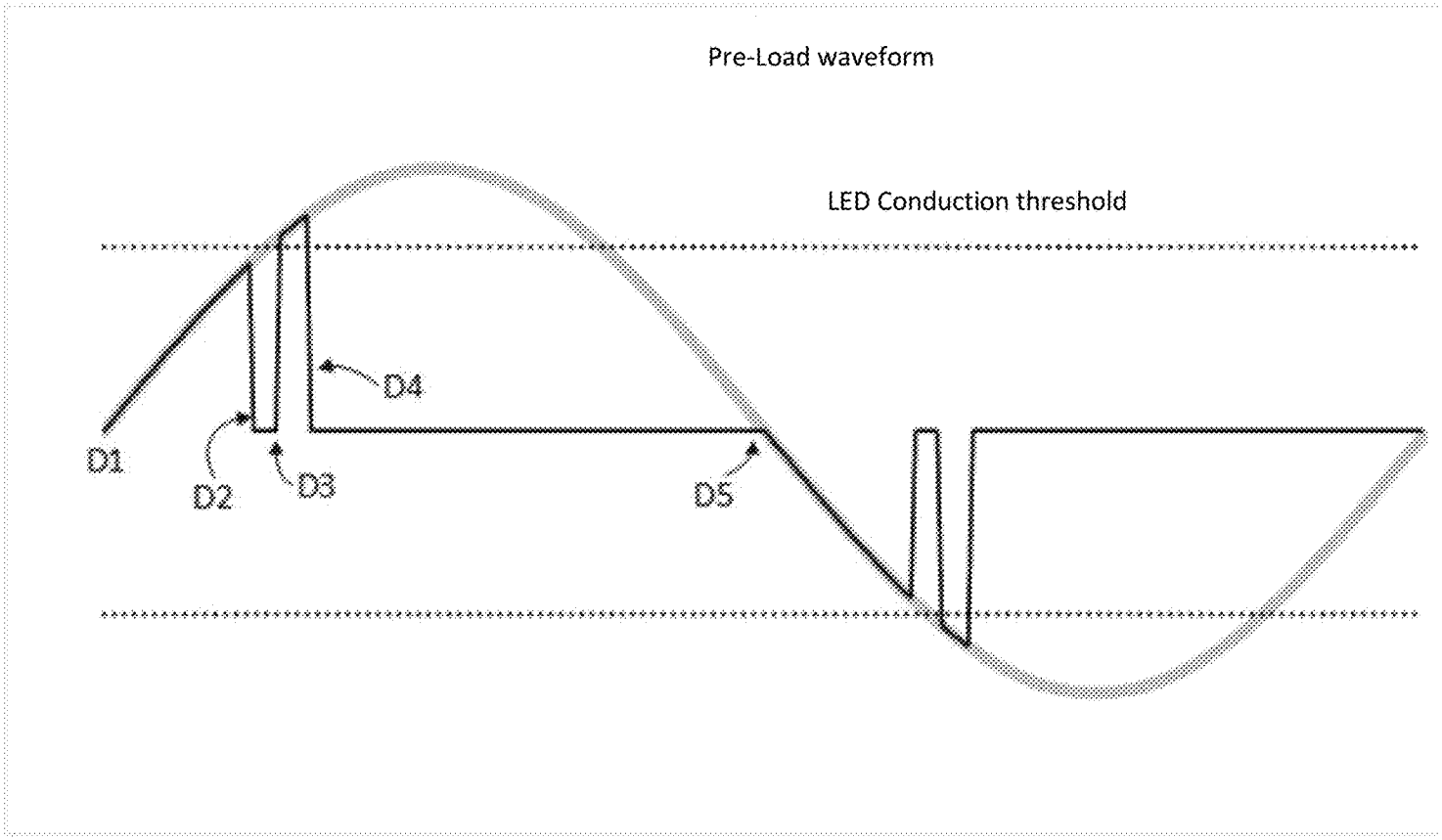
FIG. 18 illustrates the preload type control mode

In a typical embodiment in which a LED lamp is manufactured with high a capacitive reactance, the control algorithm can allow a progressive charge of the capacitor of the lamp using a slow rise time to limit inrush current from the electrical distribution network. Referring now to FIG. 18, the first activation cycle is started at the zero-crossing time D1 and ends at D2 below the conduction threshold of the LEDs. The time interval between D1 and D2 is dedicated to charge the input capacitor of the lamp below the conduction threshold of the LED. During this time, there is no luminous intensity from the lamp. A second conduction cycle is triggered when the voltage exceeds the conduction threshold of the LEDs. This cycle permits the activation of the LED segment of the lamp. The LED string activation threshold is located at D3 and the intensity is controlled by the pulse width starting at D3 and ending at D4. The increase in luminous intensity is generally achieved progressively by increasing the duration of the pulse width of the second cycle until reaching D5. The activation of the charge cycle of the input capacitor preferably begins at the zero-crossing point D1 of the main voltage but can also be enabled at any time in the range of D1 to D2.

Typically, the method makes it possible to carry out, without limitation, all waveforms presented using preprogrammed modes in order to produce the waveform adapted to the circuit of the lamp and to the topology of the installation.

In addition to the control modes defined above, the method allows the establishment of any particular periodic waveform with the voltage available from the electrical distribution network.

Although it has been described using one or more preferred embodiment(s), it should be understood that the present invention may be used, employed and/or embodied in a multitude of other forms. Thus, the following claims must be interpreted to include these different forms while remaining outside the limits set by the prior art.

The invention claimed is:

1. A control method for powering one or more dimmable lamps without flickering, each lamp including one or more light emitter device(s) and an electronic circuit that tracks a conduction angle of an AC power supply to vary light intensity of the light emitter device(s), the method comprising:

executing a sequence to alter the AC power supply to power the lamp(s), the sequence comprising:

interrupting the AC power supply to the lamp(s) one or more times per cycle of the AC electrical signal;

activating the AC power supply to the lamp(s) one or more times per cycle of the AC power supply, wherein the duration length of an activation is a conduction period; and applying a load on the AC power supply to the lamp(s) at any time during a non- conduction period one or more times per cycle of the AC power supply, the load absorbing residual energy following one or more power interruptions.

2. The control method of claim 1, the sequence starting by interrupting the AC power supply to the lamp(s) while the supply voltage is below a minimum activation threshold to turn on the lamp(s).

3. The control method of claim 1 further comprising:

storing energy of the AC power supply in a capacitor; and powering the lamp(s) with at least some of the energy stored in the capacitor.

4. The control method of claim 3, wherein the energy stored in the capacitor is restored in the form of a sinusoidal wave to power the lamp(s).

5. The control method of claim 3, wherein the energy stored in the capacitor is restored in the form of a trapezoidal wave to power the lamp(s).

6. The control method of claim 3, wherein the energy stored in the capacitor is restored in the form of an arbitrary periodic wave to power the lamp(s).

7. The control method of claim 1, further comprising:

measuring the surrounding light intensity; and in accordance with the measurement of the surrounding light intensity, altering the AC power supply powering the lamp(s) to obtain a predetermined light intensity.

8. The control method of claim 1, the sequence further comprising for each cycle of the AC power supply starting when the voltage of the AC power supply is at zero:

activating the AC power supply to the lamp(s) to adjust the conduction period at the peak of the voltage of the AC power supply, wherein the conduction period duration is at the desired light intensity.

9. The control method of claim 1, the sequence further comprising for each cycle of the AC power supply starting when the voltage of the AC power supply is at zero:

interrupting the AC power supply to the lamp(s) until the voltage from the AC power supply reaches a voltage that is at least a minimum activation threshold to turn on the lamp(s); and activating the AC power supply to the lamp(s) until the conduction period duration allows the desired light intensity to be reached.

10. The control method of claim 9, wherein in the case where the activation of the AC power supply to the lamp(s) does not allow the conduction period duration to reach the desired light intensity before the end of a cycle, the sequence comprises activation of the AC power supply to the lamp(s) before the voltage is at least at the minimum activation threshold to turn on the lamp(s) until the end of the cycle.

11. The control method of claim 1, the sequence further comprising for each cycle of the AC power supply starting when the voltage of the AC power supply is at zero:

activating and then interrupting the AC power supply to the lamp(s) several times in order to divide the cycle into several on and off conduction period durations according to a ratio, the ratio being the conduction time divided by the non- conduction time, the multiplication of the ratio by the voltage powering the lamp(s) defining an intermediate voltage to achieve a desired light intensity.

12. The control method of claim 1, the sequence further comprising for each cycle of the AC power supply starting when the voltage of the AC power supply is at zero:

activating the AC power supply to the lamp(s) until the voltage of the cycle is just below a minimum activation threshold to turn on the lamp(s);

temporarily interrupting the AC power supply to the lamp(s) until the moment when the voltage from the AC power supply exceeds the activation threshold to turn on the lamp(s); and activating the AC power supply to the lamp(s) for a duration of the cycle corresponding to the desired average light intensity.

13. The control method of claim 1, wherein each lamp comprises multiple strings of one or more LEDs, each string activating at a different voltage threshold, the sequence comprising for each cycle of the AC power supply beginning when the voltage is at zero:

(1) interrupting the AC power supply to the lamp(s) until the cycle voltage exceeds the activation threshold of a first LED string:

(2) activating the AC power supply to the lamp(s) for a duration until the desired intensity of the first string is reached; and (3) repeating steps (1) and (2) for all the other strings of the lamp(s).

14. The control method of claim 1, the method further comprising for each cycle of the AC power supply, delaying the activation(s) of the AC power supply to the lamp(s) for a few microseconds when a device drops momentarily the voltage of the AC power supply.

15. The control method of claim 1, the load being applied on the AC power supply to the lamp(s) more than once per cycle of the AC power supply.

16. A control system for powering one or more dimmable lamps without flickering, each of the lamps including one or more light emitter device(s) and an electronic circuit that tracks a conduction angle of an AC power supply to vary light intensity of the light emitter device(s), the system comprising:

at least one switch configured to disconnect the AC power supply to the lamp(s);

an activable bleeder circuit connected to the lamp(s);

a control device configured to execute a sequence to alter an AC power supply to the lamp(s), the sequence comprising:

opening the switch one or more time per cycle of the AC power supply to interrupt the AC power supply to the lamp(s);

closing the switch one or more time per cycle of the AC power supply to activate the AC power supply to the lamp(s); and activating the active bleeder following one or more of the interruptions of the AC power supply to the lamp(s) by the switch to absorb residual energy following the one or more interruptions.

17. The control system of claim 16, further comprising closing the switch when the AC power supply voltage is greater than the conduction threshold to turn on the lamp(s).

18. The control system of claim 16, wherein the device is further configured to open the switch when the light intensity reaches a predetermined light intensity.

19. The control system of claim 16, wherein the system further comprises a feedback circuit for correcting the AC power supply to the lamp(s) according to the measured light intensity.

20. The control system of claim 19, wherein the feedback circuit further comprises a light intensity sensor configured to convert the light emitted by the lamp(s) into a value proportional to the light intensity detected by the light intensity sensor.

21. The control system of claim 16, wherein the system further comprises a current limiting circuit, the current limiting circuit being configured to measure the power delivered to the lamp(s) and to open the switch (s) when the measured power exceeds the electrical capacity of the system.

22. The control system of claim 16, wherein the system further comprises one or more capacitors configured to store energy and restore at least some of the said energy stored in the capacitor to power the lamp(s) in a controlled manner.

23. The control system of claim 22, wherein the system restores at least some of the energy stored in the capacitor(s) in the form of a sinusoidal wave to power the lamp(s).

24. The control system of claim 22, wherein the system restores at least some of the energy stored in the capacitor(s) in the form of a trapezoidal wave to power the lamp(s).

25. The control system of claim 22, wherein the system restores at least some of the energy stored in the capacitor(s) in the form arbitrary periodic waveform to power the lamp(s).

* * * * *